United States Patent [19]

Henderson

[11] 3,949,452

[45] Apr. 13, 1976

[54] YARN SORTING DEVICE

[75] Inventor: Margaret Y. Henderson, Mystic, Conn.

[73] Assignee: New Venture Engineering, Inc., Manchester, Mass.

[22] Filed: Aug. 1, 1974

[21] Appl. No.: 493,771

[52] U.S. Cl. ..... 28/1 R; 28/54

[51] Int. Cl.[2] ..... D02H 13/16

[58] Field of Search ..... 28/1 R, 2, 15, 43, 44, 28/29, 54, 55, 55.5, 55.6, 56; 66/1 A

[56] References Cited

UNITED STATES PATENTS

| | | | |
|---|---|---|---|
| 248,669 | 10/1881 | Sackett | 28/15 |
| 949,732 | 2/1910 | Morrill | 28/54 X |
| 1,191,109 | 7/1916 | Lea | 28/56 |
| 1,817,469 | 8/1931 | Vickerman | 28/55.5 |
| 1,921,053 | 8/1933 | Vickerman | 28/55.5 |
| 2,123,077 | 7/1938 | Mayer | 28/15 |
| 2,263,916 | 11/1941 | Boyle | 28/15 |
| 3,054,277 | 9/1962 | Broschard | 66/1 A |
| 3,462,049 | 8/1969 | Smith | 28/2 X |
| 3,821,543 | 6/1974 | Gelin et al. | 28/54 X |

FOREIGN PATENTS OR APPLICATIONS

| | | | |
|---|---|---|---|
| 713,293 | 10/1931 | France | 28/54 |
| 1,042,156 | 10/1953 | France | 28/54 |

*Primary Examiner*—Louis K. Rimrodt
*Attorney, Agent, or Firm*—Cesari and McKenna

[57] ABSTRACT

A yarn sorting device having a multi-slotted rectangular frame member wherein each slot is suitable for receiving and retaining several strands of yarn. The strands, which have been prearranged into convenient groupings, are slid sideways into the slots so that each grouping is located in a different slot or group of slots. The slots are arranged so that each strand of yarn is accessible and may be selected and conveniently withdrawn from the sorting device without disturbing the other strands in the same or adjacent slot.

8 Claims, 3 Drawing Figures

YARN SORTING DEVICE

BACKGROUND OF THE INVENTION

Embroidery and crewelwork often require the use of short strands of yarn of different sizes, colors or textures. Therefore, it is desirable to sort the strands according to color, length or thickness and temporarily store them in a sorted array. Somewhat similar devices for guiding and separating yarn are known in the art. A typical yarn guide is shown, for example, in U.S. Pat. No. 3,054,277. Basically, it is a rectangular card having several openings with restricted access arranged along its length. Each opening loosely receives a single strand of yarn so that the device can guide and separate several strands of yarn. Accordingly, this prior device is useful for feeding continuous strands of yarn from spools to a workpiece since it prevents the tangling and crossing of individual yarn strands.

U.S. Pat. No. 3,588,081 shows another similar comb-type arrangement for guiding and separating individual strands of wire with each wire being resiliently clamped in a different slot in a rectangular frame member.

While at first glance these prior guides and separators might seem to be suitable to sort yarn in the manner intended here, in reality they are not satisfactory for this purpose. In the former, strands segregated in a given opening would be bunched and tangled together, making it difficult to grasp a single strand. Moreover, when one strand is pulled from the device, it would invariably drag one or more other strands in the same group along with it.

In the latter type of conventional separator, the strands in each group would also drape over one another and be relatively inaccessible. In addition, it would be difficult to withdraw the yarn strands without breaking them because the strands would all be resiliently clamped in place.

Accordingly, it is an object of this invention to provide a yarn sorter for maintaining strands of yarn in selected groupings.

It is a further object of this invention to provide a yarn sorter which arranges the individual yarn strands of each group so that they are both visible and accessible.

A further object is to provide a sorter of this general type which dispenses yarn strands one at a time.

SUMMARY OF THE INVENTION

Briefly, the present yarn sorter comprises a thin, elongated card having a plurality of numbered slots extending in from an edge and spaced along the card. Each slot is deep enough to receive several strands of yarn. Further, each slot is narrow enough to gently grip all the strands in that slot so that the strands cannot fall out, yet can be withdrawn from the slot by hand with a moderate pulling force.

Normally, the different yarn strands are grouped according to color, texture, etc. and the yarn strands of the different groups are placed in different numbered slots. A novice may then follow simplified instructions for making a particular article by appropriately selecting the yarn strands of each group according to numbers given in the instructions.

In order to facilitate yarn strand selection, the slots are oriented relative to the longitudinal axis of the card so that when the card is held properly, the strands in each slot hang down vertically, yet side-by-side, so that each individual strand in each slot is quite visible and accessible to the user. The user can easily withdraw any strand from the sorter by grasping the strand and pulling it away from the card. The most natural motion automatically pulls the strand orthogonally against a side of the slot rather than along the slot so that the strand does not drag adjacent strands within the same slot along with it. Thus, only one strand at a time can be selected and withdrawn from the sorter.

The subject sorter is small and unobtrusive so that it can be carried quite easily in most crewelwork or knitting bags. Furthermore, it is quite inexpensive especially if it is a simple molded plastic part. Consequently, it should prove to be a valuable knitting or crewelwork tool.

DRAWING

DESCRIPTION OF THE PREFERRED EMBODIMENTS

Figure 1:
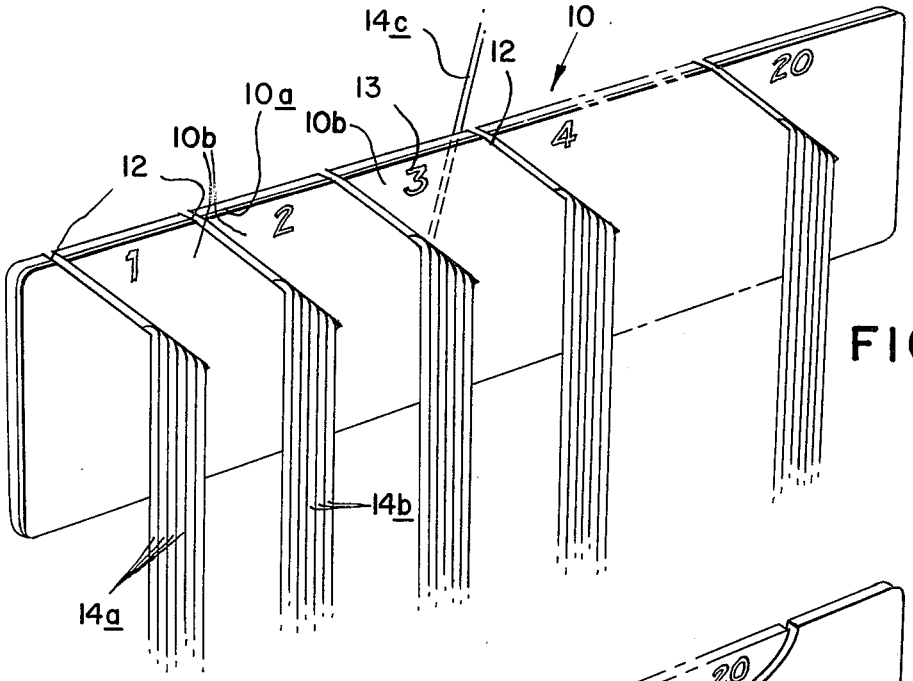
FIG. 1 is an isometric view of one embodiment of my yarn sorter.

FIG. 1 shows one embodiment of the invention consisting of an essentially flat or planar rectangular card 10 having a plurality of slots 12. The illustrated card has only five such slots. An actual sorter may have twenty or more slots 12 distributed along the length of the card. These slots are formed by spaced, coplanar, side portions 10b. The card is made of a suitable flexible, impact-resistant plastic such as high-impact styrene, polypropylene or the like. In some cases, it has a laminated plastic skin 10a of a different color on at least one face so that identifying numbers 13 can be formed next to the slots by striking through the laminate to expose the underlying card material. Alternatively, the numbers can be printed or molded into the card. Raised numbers or letters could even be in Braille form to aid blind persons engaged in this work.

Slots 12 are typically on the order of one inch deep so that each slot can hold many strands of yarn. Each slot has a transverse dimension which is about the same as the diameter of a typical strand of yarn (e.g., 1/20 to 1/16 inch) so that when a strand is placed sideways in the slot, the walls of the slot gently grip either the strand itself or fluff on the strand between them so that it takes a slight amount of effort to pull the strand from the slot. The slots should not be so narrow that the strand breaks when it is withdrawn from the sorter.

In the FIG. 1 embodiment, the slots 12 are straight and parallel to one another and arranged obliquely to the longitudinal axis of card 10. Accordingly, when yarn strands 14 are placed in each slot and the card is held horizontally, the strands tend to lie side-by-side as shown in the figure so that the strands do not overlap and each and every strand can easily be seen and grasped by the user.

Usually the yarn strands are prearranged into correct groups and each grouping is entered into a separate slot or group of slots. Thus, strands **14*a* are situated in slot No. 1, strands 14*b* are placed in slot No. 2, etc. In use, the sorter is held substantially horizontally by the user or a suitable support (not shown) at a convenient height for inspection of the yarn groupings. The user selects a strand of yarn from the appropriate group desirably but not necessarily near the top of its slot 12. The sorter shown in FIG. 1 with slots 12 which decline down and to the right is ideally suited for use by a right-handed person who would hold it in his left hand. The user grasps a selected yarn strand, say strand 14***c*, with his right hand and pulls it up and to the right. This normal arm movement pulls strand 17*a* against the wall of the slot rather than along the length of the slot. Accordingly, the strand 14*c* is withdrawn from the sorter without becoming entangled with other strands in the same slot or in adjacent slots or without dragging them along with it or pushing them out of the slot.

Of course, the slots 12 could incline in the opposite direction, in which case, the sorter would be more appropriate for a left-handed person. Alternatively, in some applications, it may be more appropriate for the slots to have only a segment thereof oriented at an angle with respect to the axis of the card 10. For example, the slot could extend in perpendicular to the axis and then bend so that the inner portion of the slot is oblique or parallel to the card 10 axis.

Figure 2:
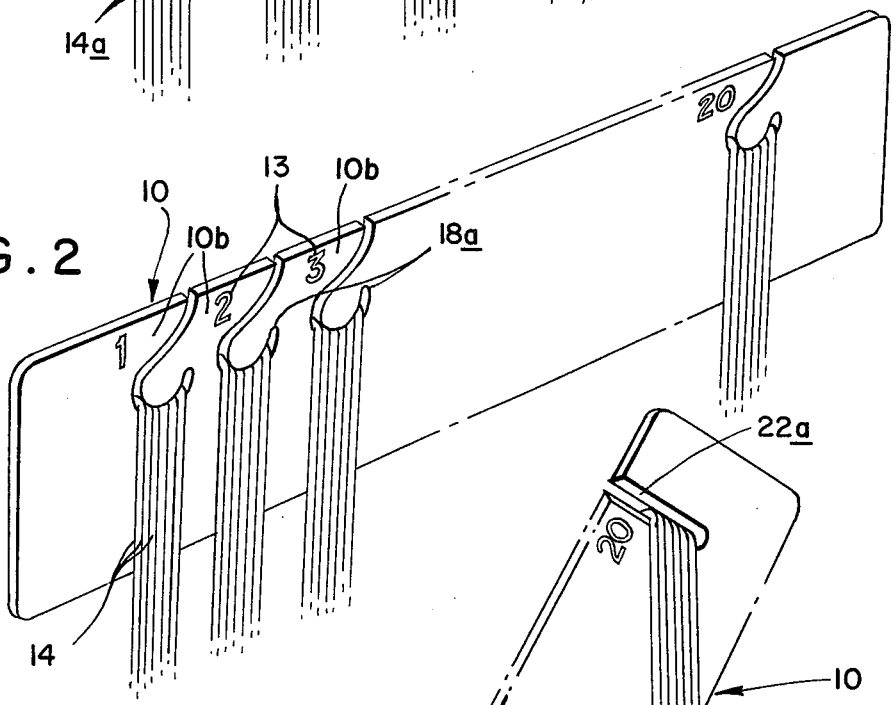
FIG. 2 is a similar view of an alternate embodiment thereof.

FIG. 2 shows such an embodiment of the yarn separator in which the oblique straight parallel slots 12 shown in FIG. 1 are replaced by "parallel" hook-shaped slots 18. The yarn strands 14 of all the groups are entered in slots 18 and positioned at the arcuate closed ends 18*a* of the slots. With this embodiment also, all of the strands are visible and easily grasped. A yarn strand anywhere in any slot may be selected and pulled out of the slot perpendicularly to the slot walls without disturbing the other strands in the same slot or adjacent slots. Furthermore, in this embodiment as well as the others, the inclined slots should reduce any tendency of the strands to pull out of the sorter during storage or use.

Figure 3:
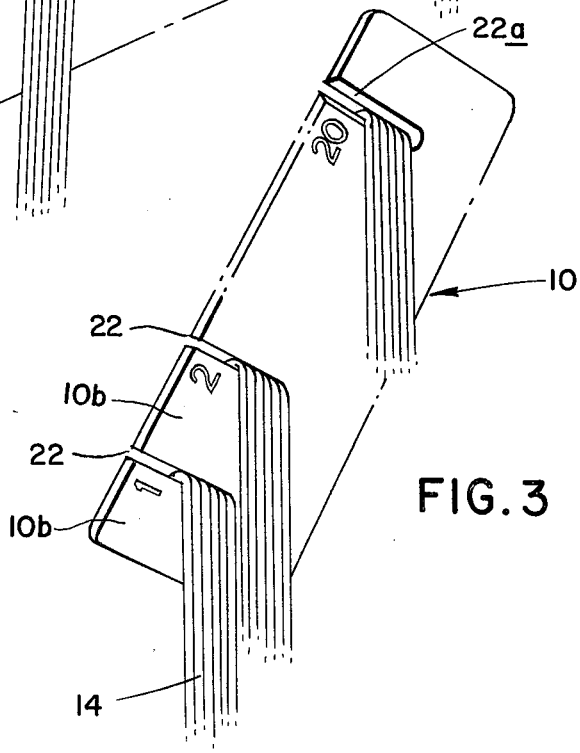
FIG. 3 is a similar view of a further sorter embodiment.

FIG. 3 shows still another sorter embodiment in which the slots 22 are arranged at right angles to the card 10 axis. This sorter is best held at an angle as shown so that the yarn strands hang vertically side-by-side for the reasons described above.

In this embodiment as well as the others, it may be desirable to bevel the sides of the slots as shown at 22a in FIG. 3. This makes it easier to withdraw the strands from behind the sorter without making them any less secure in their respective slots. In addition, the beveled edge engages less of the yarn so the slot itself can be made narrower than the other slots 22.

It will be seen from the foregoing then that the present yarn sorter not only sorts and segregates yarn strands of different groups, but displays and dispenses them in such a manner that each strand can easily be placed or replaced in the yarn sorter and can be selected, grasped and withdrawn from the sorter as needed by the user. Furthermore, the unit is small so that it can fit conveniently in bag or pocket and it is rugged so that it should have a long, useful life.

Further, it will be appreciated that the objects set forth above, among those made apparent from the preceding description, are efficiently attained and, since certain changes may be made in the above construction without departing from the scope of the invention, it is intended that all matter contained in the above description or shown in the above description or shown in the accompanying drawings shall be interpreted as illustrative and not in a limiting sense.

I claim:

1. A yarn sorter for segregating different groups of yarn strands comprising an elongated, planar member including a plurality of slot portions formed therein for retaining yarn strand groups, said slot portions:

A. being spaced along the length of said planar member and extending into and opening to a long edge of said planar member, and B. each said slot portion being formed by spaced side portions of said planar member, adjacent side portions being substantially uniformly spaced apart by a width which is narrower than the diameter of a yarn strand and having a depth which is a plurality of times greater than a diameter of a yarn strand, said side portions remaining in a substantially planar configuration when yarn strands are inserted thereby to form slot portions which can grip a plurality of yarn strands in a side-by-side relation and permit the withdrawal of any strand in the group without disturbing other strands in said sorter.

2. The yarn sorter defined in claim 1 wherein the side edges of the slots are beveled.

3. The yarn sorter defined in claim 1 wherein the member is a flexible, resilient plastic card.

4. The yarn sorter defined in claim 3 wherein

A. the card is composed of two laminae of different colors, and

B. further including openings in the first lamina which expose underlying portions of the second lamina so as to form slot-identifying indicia on the card.

5. The yarn sorter defined in claim 1 wherein each slot has at least one segment oriented at an angle of less than ninety degrees with respect to the longitudinal axis of the member so that, in use, the strands in the slots hang vertically side-by-side so that an end of each strand is visible and accessible.

6. The yarn sorter defined in claim 5 wherein the slots are parallel and equally spaced along the member.

7. The yarn sorter defined in claim 5 wherein the slots are straight.

8. The yarn sorter defined in claim 6 wherein the slots are hook-shaped.

* * * * *